US009968994B2

(12) United States Patent
Numano et al.

(10) Patent No.: US 9,968,994 B2
(45) **Date of Patent: *May 15, 2018**

(54) CASTING NOZZLE

(71) Applicant: SUMITOMO ELECTRIC INDUSTRIES, LTD., Osaka (JP)

(72) Inventors: Masatada Numano, Osaka (JP); Yoshihiro Nakai, Osaka (JP); Toshiya Ikeda, Osaka (JP); Mitsuyuki Kobayashi, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/487,971

(22) Filed: Sep. 16, 2014

(65) Prior Publication Data

US 2015/0001262 A1 Jan. 1, 2015

Related U.S. Application Data

(63) Continuation-in-part of application No. 11/886,660, filed as application No. PCT/JP2006/302980 on Feb. 20, 2006, now Pat. No. 8,863,999.

(30) Foreign Application Priority Data

Mar. 24, 2005 (JP) ..... 2005-087328

(51) Int. Cl.
*B22D 41/00* (2006.01)
*B22D 11/06* (2006.01)

(52) U.S. Cl.
CPC ..... *B22D 11/0642* (2013.01)

(58) Field of Classification Search
CPC ..... B22D 11/0642
(Continued)

(56) References Cited

U.S. PATENT DOCUMENTS 4,175,611 A 11/1979 Fletcher
4,588,112 A 5/1986 Kondo
(Continued)

FOREIGN PATENT DOCUMENTS

EP 1704947 A1 9/2006
JP 60-092053 A 5/1985
(Continued)

OTHER PUBLICATIONS

European Office Action issued in European Patent Application No. 06714120.0 dated Aug. 23, 2012.
(Continued)

*Primary Examiner* — Kaj K Olsen
(74) *Attorney, Agent, or Firm* — McDermott Will & Emery LLP

(57) ABSTRACT

A casting nozzle suited to manufacture a casting material of pure magnesium or magnesium alloy is provided. A nozzle is utilized to manufacture a casting material by supplying molten metal to a portion between rolls which become a casting die, and arranged so that a pouring port is located between a pair of rolls opposed to other. This nozzle includes a main body formed of oxide material such as alumina, and a coating layer which is provided on the inner surface of the main body which comes into contact the molten metal, and formed of material that does not include oxygen substantially. Since the main body does not come into direct contact with the molten metal due to the coating layer, it is possible to prevent oxygen included in the main body from reacting with the molten metal. Further, in the nozzle, a casting die contact portion which comes into contact with the rollers is formed of thermal insulation material, whereby it is prevented that the molten metal in the nozzle is cooled through the casting die contact portion by the rollers.

1 Claim, 3 Drawing Sheets

(58) Field of Classification Search
USPC ..... 222/591, 594
See application file for complete search history.

(56) References Cited

U.S. PATENT DOCUMENTS

| | | | | |
|---|---|---|---|---|
| 5,799,720 | A | 9/1998 | Ross et al. | |
| 5,924,476 | A | 7/1999 | Spink | |
| 6,363,999 | B1 | 4/2002 | Smith | |
| 2003/0124395 | A1 | 7/2003 | Whittle et al. | |
| 2004/0241446 | A1* | 12/2004 | Tsukamoto et al. | 428/408 |
| 2005/0173473 | A1 | 8/2005 | Awajiya et al. | |
| 2005/0236135 | A1 | 10/2005 | Liang et al. | |

FOREIGN PATENT DOCUMENTS

| | | | |
|---|---|---|---|
| JP | 63-043748 | A | 2/1988 |
| JP | 05-318040 | A | 12/1993 |
| JP | 6-182503 | A | 7/1994 |
| JP | 11-226702 | A | 8/1999 |
| JP | 2000-263194 | A | 9/2000 |
| JP | 2004-009110 | A | 1/2004 |
| JP | 2004-052087 | A | 2/2004 |
| JP | 2004-249291 | A | 9/2004 |
| JP | 2005-068469 | A | 3/2005 |
| WO | 97/09139 | A1 | 3/1997 |
| WO | 02/083341 | A1 | 10/2002 |
| WO | 2004/020126 | A1 | 3/2004 |
| WO | 2006/003855 | A1 | 1/2006 |

OTHER PUBLICATIONS

Korean Office Action issued in corresponding Korean Application No. 10-2013-7034792, dated Mar. 31, 2014, with English translation.

Canadian Office Action, issued in Canadian Patent Application No. 2,601,802, dated Jan. 11, 2012.

Australian Office Action issued in Australian Patent Application No. AU 2006225914 dated Apr. 19, 2010.

Korean Office Actioon with English translation issued in application No. 10-2007-7021472 issued on May 3, 2012.

Japanese Notification of Reason for Refusal, with English translation, issued in Japanese Patent Application No. 2005-087328, dated Jan. 6, 2010.

European Search Report issued in Patent Application No. 06714120.2-2122 dated Nov. 18, 2008.

Smith, D., et al., "FATA Hunter Optiflow® Variable Tip Width Adjustment System for Aluminum Sheet Casting," TMS Light Metals: Light Metals, Proceedings of the Technical Sessions, Technical TMS Annual Meeting, XX, XX, Mar. 14, 2004, pp. 719-722, XP009099115.

International Preliminary Report on Patentability and Written Opinion of the International Searching Authority issued in International Application No. PCT/JP2006/302980, dated Oct. 4, 2007.

Korean Office Action issued in Korean Application No. 10-2015-7004923 dated Nov. 25, 2015, with English Translation.

* cited by examiner

CASTING NOZZLE

CROSS REFERENCE TO RELATED APPLICATIONS

This application is a continuation-in-part of U.S. patent application Ser. No. 11/886,660, filed on Jan. 18, 2008, which is the U.S. National Phase under 35 U.S.C. § 371 of International Application No. PCT/JP2006/302980, filed on Feb. 20, 2006, which claims priority to Japanese Patent Application No. 2005-087328, filed on Mar. 24, 2005, the disclosures of each are hereby incorporated by reference herein.

TECHNICAL FIELD

The present invention relates to a casting nozzle which supplies, when continuous cast is performed by means of a twin roll movable casting die, molten metal into the movable casting die. Particularly, it relates to a casting nozzle suited to manufacture a casting material of pure magnesium or magnesium alloy.

BACKGROUND ART

Heretofore, there has been known continuous cast in which molten metal is supplied into a movable casting die formed by a roll and a belt, this molten metal is brought into contact with the casting die thereby to be cooled and solidified, and a casting material is continuously manufactured. As such the continuous cast, there is, for example, a twin roll method using a twin roll movable casting die composed of a pair of rolls. In this method, a pair of rolls which rotate in opposite directions to each other are arranged opposed to each other, and molten metal is poured between the rolls thereby to obtain a casting material. This twin-roll method is used generally in manufacture of sheet materials of pure aluminum and aluminum alloy. As a nozzle which supplies the molten metal between the rolls, a nozzle formed of thermal insulation material such as aluminum or silica has been known (refer to, for example, Patent Document 1)

On the other hand, Mg is smaller in specific gravity (density g/cm$^3$, 20° C.: 1.74) than the above Al, and is the most lightweight of metal materials used for structure. Therefore, as a material in various fields where weight reduction is required, great expectations are harbored on magnesium alloy having pure magnesium or Mg as a main component. For example, manufacture of a casting material by continuous cast as a magnesium alloy material has been described in Patent Document 2.

Patent Document 1: JP-A-11-226702

Patent Document 2: International Publication No. 02/083341 pamphlet

DISCLOSURE OF THE INVENTION

Problems to be Solved by the Invention

When a casting material of pure magnesium or magnesium alloy is manufactured, continuous cast by the twin-roll method enables mass production similarly to the case of the casting material of aluminum alloy. However, in case that the casting nozzle used in casting of the aluminum alloy is used as it is, since Mg is the active metal, the molten metal reacts with the oxide such as silica or aluminum which forms the nozzle, so that a problem that casting is difficult arises.

Therefore, an object of the invention is to provide a casting nozzle suited to manufacture a casting material of pure magnesium or magnesium alloy with good productivity.

Means for Solving the Problems

In case that a casting nozzle formed of the oxide material such as aluminum or silica, which is used in continuous cast for pure aluminum or aluminum alloy, is used in the continuous cast of pure magnesium or magnesium alloy, a nozzle portion with which molten metal comes into contact is formed of low oxygen material, whereby it is possible to prevent the oxygen included in the nozzle forming material from reacting with the molten metal. Further, in a twin-roll casting method, a nozzle is arranged so that a pouring port provided at a leading end of the nozzle is brought as close to rolls as possible. Specifically, the nozzle leading end and the rolls are arranged in contact with each other so that the nozzle leading end is put between the rolls. At this time, if the nozzle is formed of not thermal insulation material but material that is good in thermal conductivity, the contact between the nozzle and the rolls causes the molten metal to be cooled by the rolls through the nozzle, or the molten metal is cooled by air of the nozzle outside. Hereby, there is fear that the molten metal will be solidified in the nozzle before being poured between the rolls. Particularly, in case that the rolls have water cooled structure, the molten metal is easier to be cooled through the nozzle. However, in case that at least the portion where the nozzle comes into contact with the rolls is formed of the thermal insulation material, it is possible to prevent the molten metal from being cooled by the rolls through the nozzle. On the basis of these knowledge, the invention specifies that at least a part of a portion in the nozzle which comes into contact with the molten metal is formed of low oxygen material that is low in oxygen content, and a portion in the nozzle which comes into contact with the rolls (movable casting die) is formed of thermal insulation material.

Namely, the casting nozzle of the invention, which supplies molten metal of pure magnesium or magnesium alloy into a twin roll movable casting die, is constituted by at least two layers, of which at least an inner layer is formed of low oxygen material. Further, the casting nozzle of the invention, which supplies molten metal of pure magnesium or magnesium alloy into the twin roll movable casting die, includes a molten metal contact portion which comes into contact with the molten metal, a casting die contact portion which comes into contact with the movable casting die, and a pouring port from which the molten metal is poured into the movable casting die. The casting die contact portion is formed of thermal insulation material, and at least a part of the molten metal contact portion is formed of low oxygen material. The invention will be described below in detail.

The casting nozzle of the invention is utilized as a transporting path for supplying the molten metal of pure magnesium or magnesium alloy into the movable casting die. Particularly, the nozzle of the invention is used in continuous cast by a twin roll method using a twin roll movable casting die. In the twin-roll casting method, a pair of cylindrical rolls (movable casting die) which rotate in the opposite directions to each other are arranged opposed to each other with the predetermined space, and the molten metal is poured between these rolls and cooled by contact with the rolls, whereby the molten metal is solidified and a casting material is manufactured continuously. In case that as this movable casting die, a movable casting die having water cooled structure in which a cooling water path is provided inside the roll and water flows inside the roll is utilized, cooling speed of the molten metal can be heightened, and growth of a crystallization or crystal grain is suppressed, whereby a casting material having microstructure can be obtained. A twin roll movable casting die or a twin roll casting machine which are utilized in continuous cast of aluminum alloy may be utilized.

The nozzle of the invention is arranged between a pouring basin for storing temporarily the molten metal from a melting furnace which melts metal and the movable casting die to transport the molten metal, for example, so that one end side of the nozzle is fixed to the pouring basin and the other end side thereof is arranged between the rolls, or the nozzle is arranged between the melting furnace and the movable casting die integrally with the pouring basin to transport the molten metal. It is enough that such the nozzle of this invention has the shape in which the molten metal can be transported. Particularly, in order to prevent the molten metal from reacting with oxygen in air due to contact of the molten metal with the external air in the transporting time, it is preferable that the nozzle is formed cylindrically so that the molten metal does not come into contact with the external air. At this time, the nozzle may be integrally formed cylindrically, or may be formed cylindrically by combination of plural members. In this cylindrical nozzle, one of opening portions is used as a pouring port from which the molten metal is poured into the movable casting die, and the other opening portion is used as a supply port for supplying the molten metal from the melting furnace or the pouring basin into the nozzle. The pouring port is arranged as close to the rolls as possible. Specifically, the nozzle is arranged in partial contact with the rolls (movable casting die) so that the pouring port is arranged between the rolls. In case that the pouring port is arranged apart from the movable casting die, meniscus (molten metal surface formed in an area from the nozzle leading end to a portion where the molten metal that has flown out from the nozzle leading end comes firstly into contact with the movable casting die becomes large, and a ripple mark becomes large, so that there is produced a disadvantage that surface quality of a casting piece is lowered or the molten metal leaks to the outside of the casting die.

As described above, since the nozzle is arranges so that a part of the nozzle comes into contact with the movable casting die during casting, at least the contact portion with movable casting die (casting die contact portion) in the nozzle of the invention is formed of thermal insulation material. In case that the casting die contact portion is formed not of the thermal insulation material but of material that is good in thermal conductivity, the molten metal is cooled through the nozzle by the rolls as described above, so that there is produced a disadvantage that the molten metal is solidified before being transported between the rolls thereby to disenable casting. As the casting die contact portion, there is specifically a peripheral portion near the pouring port. The casting die contact portion located on the peripheral side of the nozzle is a portion which comes seldom into contact with the molten metal, or a portion which never comes into contact with the molten metal. Accordingly, even in case that high oxygen material that is comparatively high in oxygen density, for example, oxide material is used as the thermal insulation material which forms the casting die contact portion, the disadvantage that the molten metal reacts with oxygen included in the oxide arises seldom, or never arises. As the oxide material, there is, for example, material which has mainly aluminum oxide (alumina, $Al_2O_3$), calcium silicate ($CaSiO_3$) or silicon oxide (silica, $SiO_2$). Further, the oxide material has a thermal conductivity of 1.00 W/mK at 600° C. or less. Further, the oxide material has a density of 1.10 g/cc or less. As the thermal insulation material formed of such the oxide material, there is a thermal insulation material in which unwoven fabric such as aluminum fiber or glass fiber is hardened by silicate of soda. As other thermal insulation materials, a material having calcium silicate as a main component, a material having boron nitride sintered compact as a main component, or a material having aluminum sintered compact as a main component may be used. The main component means a component having content of 50 mass % or more. Further, thermal insulation material may be used, which has at least one selected from alumina, silica, calcium silicate, boron nitride sintered compact, and aluminum sintered compact as a main component, and at least one of carbon and graphite as an additive. By including carbon or graphite, there are advantages that thermal shrinkage of the thermal insulation material becomes small, voids of the thermal insulation material are filled and rigidity improves, and isolation from the outside improves more because the voids of the thermal insulation material are filled. The content of carbon or graphite is appropriately about 5 to 30 mass %. Further, alumina-graphite material or alumina-silica material which is on sale as refractory material may be used. The casting die contact portion may be formed of one kind of thermal insulation material or two or more kinds of thermal insulation materials, and may have multi-layered structure composed of plural kinds of thermal insulation materials. Further, a thermal insulation material including pores therein is high in thermal insulation properties and can suppress heat radiation. Further, the thermal insulation material including the pores is easier to deform elastically than the thermal insulation material including no pores or the thermal insulation material including a few pores. Therefore, even in case that the rolls rotate, a state where the nozzle is brought into contact with the rolls is easy to keep. As the thermal insulation material including the pores, there is, for example, a thermal insulation material which utilizes a compression mold body formed of aluminum fibers.

Though only the casting die contact portion may be formed of the thermal insulation material, the whole near the pouring port may be formed of the thermal insulation material, or the whole of the nozzle (except for at least a part of the molten metal contact portion described later) may be formed of the thermal insulation material as the conventional nozzle used in manufacture of the aluminum alloy by casting. In case that the whole of the nozzle is formed of the thermal insulation material, the molten metal temperature is difficult to lower till the molten metal comes into contact with the rolls, and the molten metal can be transported in a high temperature state. In case that the whole near the pouring port or the whole of the nozzle is formed of the thermal insulation material, if the thermal insulation material is composed of material that is comparatively low in rigidity, there is fear that the portion near the pouring port or the other portion will be distorted (deformed) by weight of the molten metal and weight of the nozzle itself. Particularly, in case that a wide casting material is manufactured, it is desirable that the width of the pouring port is made large and the predetermined section area of the pouring port is kept so that the molten metal can be uniformly supplied in the width direction of the roll. However, in case that the thermal insulation material is composed of the low rigid material, there is a case where widening of the pouring port causes distortion of a center portion of the pouring port thereby to disenable securement of the predetermined sectional area of the pouring port. Therefore, in case that the whole near the pouring port or the whole of the nozzle is formed of the thermal insulation material, it is preferable that the thermal insulation material that is comparatively high in rigidity is utilized to avoid the disadvantage that the portion near the pouring port is distorted by weight of the thermal insulation material itself or the other portion than the pouring port is also distorted by the weight of the molten metal. As high rigid material, there is material having alumina sintered compact or boron nitride sintered compact as a main component.

In case that the low rigid material is used as the thermal insulation material, for example, thermal insulation material having aluminum fiber or glass fiber as a main component or thermal insulation material having calcium silicate as a main component, a reinforcement member may be arranged to prevent the distortion. The reinforcement member is arranged in a spot where the distortion is easy to be produced, for example, at the periphery of the thermal insulation material forming the pouring port, or inserted into the thermal insulation material forming the portion near the pouring port to be built in the thermal insulation material. In the nozzle formed of the thermal insulation material, the reinforcement member may be arranged also in other spots than the portion near the pouring port, for example, at the periphery of the portion which is easy to be distorted by weight of the molten metal, or may be built in the portion which is easy to be distorted. A case where there is no space for arranging the reinforcement member at the periphery of the portion near the pouring port located in the narrow space which is between the rollers is thought. In such the case, it is preferable that the reinforcement member is inserted into the nozzle forming member to be built in the nozzle forming member. As long as the reinforcement member is good in strength, any material may be used as the reinforcement member. For example, as the reinforcement members, there are a bar material, a plate material and a net material formed of metal such as stainless or steel. Particularly, stainless is preferable because it has good strength even under the environment of high temperature and is mall in deformation by a thermal distortion. Further, the arrangement position and size of the reinforcement member may be changed appropriately according to a material and a thickness of the thermal insulation material forming the nozzle, and a width and a length of the nozzle.

Alternatively, even in case that the thermal insulation material composed of the low rigid material is used, by adjusting supply pressure of the molten metal, the distortion may be eliminated when the molten metal passes through the thermal insulation material forming the nozzle, whereby the pouring port can keep the predetermined section area. There is fear that there is no space for arranging the reinforcement member near the pouring port because the pouring port is arranged between the rollers as described above. In such the case, by adjusting the supply pressure of the molten metal, the predetermined section area may be secured. It is enough that the supply pressure has such a magnitude that the nozzle can deform so that the distortion is eliminated and the predetermined sectional area can be secured. If the supply pressure is made too high, there is fear that the nozzle is damaged or the molten metal leaks from a gap between the nozzle and the movable casting die. As the thermal insulation material composed of the low rigid material, there is used a thermal insulation material having such strength that the nozzle is not damaged even in case that the nozzle is distorted (deformed) by the weight of the molten metal.

On the other hand, in case that the thermal insulation material is composed of the oxide material such as aluminum or silica, when the whole of the nozzle is formed of such the thermal insulation material, oxygen in the oxide material and Mg of the molten metal react with each other by contact of the molten metal with the nozzle, so that casting cannot be performed, or the nozzle forming material is molten and mixed in the molten metal, so that quality of a casting material lowers. Therefore, in the invention, at least a part of the molten metal contact portion with which the molten metal comes into contact is formed of low oxygen material which is low in oxygen density than the oxide material, and preferably does not include oxygen substantially. As the low oxygen material, it is preferable that the oxygen density is 20 mass % or less. For example, a plate material of metal such as molybdenum which is difficult to react with Mg, a ceramics material such as SiC which is low in oxygen content, boron nitride or graphite can be used, which will be described in detail later. In the nozzle, the molten metal contact portion which comes into contact with the molten metal is usually an inner surface of the nozzle. Accordingly, for example, the whole of the nozzle main body may be formed of the thermal insulation material and particularly formed of the thermal insulation material which is high in oxygen density, and at least a part of the inner surface of this nozzle main body may have a coating layer formed of the low oxygen material, or the entire surface of the inner surface thereof may be have the coating layer. Further, only the portion near the pouring port may be formed of the thermal insulation material and the other portions may be formed of the low oxygen material, or only the casting die contact portion may be formed of the thermal insulation material and the other portions may be formed of the low oxygen material.

As the portion formed of the low oxygen material in the molten metal contact portion, or as the portion having the coating layer formed of the low oxygen material, specifically, there is a portion which comes into contact with the molten metal of Tm+10° C. or more, in which Tm° C. is a melting point (liquidus temperature) of pure magnesium or magnesium alloy. When the inventors cast molten metal of magnesium alloy by means of a nozzle formed of oxide material, they obtained knowledge that reaction between the nozzle and the molten metal is started in a portion of the nozzle which comes into contact with the molten metal of Tm+10° C. or more thereby to cause damage of the nozzle. The temperature of the molten metal which is transported from the pouring basin side of the nozzle (or the melting furnace side thereof) to the pouring port side, even in case that the nozzle is formed of the thermal insulation material, lowers gradually toward the pouring port side, and comes nearly to the melting point near the pouring port where solidification is started, even in case that the temperature of the molten metal in the pouring basin or the melting furnace has come to a temperature above the melting point. Therefore, when the inventors have investigated a relation between temperature distribution of the molten metal in the nozzle and reaction of the molten metal with oxygen, they have found that the reaction between the oxygen and the molten metal occurs in the portion of the nozzle which comes into contact with the molten metal of Tm+10° C. or more as described above. Therefore, in the nozzle, the portion including the portion which comes into contact with the molten metal of Tm+10° C. or more is formed of the low oxygen material, or the coating layer formed of the low oxygen material is provided in the same portion. More preferably, the above portion is formed of material which does not substantially include the oxygen, or the coating layer formed of the material which does not substantially include the oxygen is provided in the same portion. Specifically, the portion in the nozzle where the molten metal of the Tm+10° C. or more passes is on the pouring basin side or on the melting furnace side. Accordingly, the portion near the pouring port which comes into contact with the molten metal below Tm+10° C. is may be formed of material that is high in oxygen density, for example, thermal insulation material composed of the oxide material. Namely, in the nozzle, the portion on the pouring basin side or on the melting furnace side may be formed of the low oxygen material and the portion on the pouring port side may be formed of the thermal insulation material composed of the oxide material; or in the inner surface of the nozzle main body formed of the above low oxygen material and the thermal insulation material, a coating layer formed of the low oxygen material may be provided on the pouring basin side or the melting furnace side, or this coating layer may be provided on the entirety of the inner surface of this nozzle main body. Alternatively, the whole of the nozzle main body may be formed of the thermal insulation material composed of the oxide material, and a coating layer formed of the low oxygen material may be provided at least on the pouring basin side or on the melting furnace side in the inner surface of the nozzle main body or this coating layer may be provided on the entirety of the inner surface of this nozzle main body. Namely, for the nozzle main body formed of the thermal insulation material composed of oxide material, which is utilized in casting of aluminum alloy, the coating layer is provided, whereby its nozzle can be utilized in casting of pure magnesium or magnesium alloy. At this time, in case that the coating layer is provided near the pouring port, the sectional area of the pouring port is reduced by the coating layer. Reduction of the sectional area of the pouring port causes increases in decreases of pressure applied onto the molten metal after the molten metal has been discharged from the pouring port, so that the filling rate of the molten metal in the gap between the pouring port and the movable casting die lowers. Therefore, meniscus formed in a portion till the molten metal discharged from the pouring port comes into contact with the movable casting die becomes large, so that there is fear that surface properties of the casting piece lower. Therefore, it is preferable that adjustment of increasing supply pressure of the molten metal and heightening supply speed thereof is appropriately performed. On the other hand, in case that the coating layer is not provided near the pouring port, since the sectional area of the pouring port is not reduced by the coating layer, the casting material that is good in surface properties can be obtained without increasing the supply pressure. By utilizing the thus constructed nozzle of the invention, it is possible to prevent the nozzle and the molten metal from reacting with each other and to prevent the molten metal from being cooled by the rolls through the nozzle, so that the casting material of a pure magnesium or magnesium can be manufactured with good productivity.

As the low oxygen material, there is, for example, one or more material selected from boron nitride, graphite, and carbon. In addition, there is one or more metallic material selected from iron, titanium, tungsten, and molybdenum, and alloy material including these metallic elements of 50 mass % or more, such as stainless. Since these materials are good also in thermal conductivity, in case that the nozzle portion on the pouring basin side or on the melting furnace side is formed of this good thermal conductive material, when a heating unit such as a heater is arranged at the periphery of the portion formed of this good thermal conductive material to heat the molten metal, the decrease in the temperature of the molten metal till the molten metal comes into contact with the roll can be effectively reduced. Since the pouring basin side or the melting furnace side of the nozzle is apart from the rolls, its side is easy to secure space for arranging the heating unit such as the heater. Of the above low oxygen materials, particularly, boron nitride, carbon, and graphite do not include oxygen substantially, and have an advantage that corrosion due to reaction with the molten metal of the pure magnesium or the magnesium alloy is difficult to occur. Therefore, these materials are particularly preferable. The graphite may be natural graphite or artificial graphite.

In case that the coating layer is formed of the low oxygen material, for example, the above material may be formed in the shape of a plate to be fixed on the inner surface of the nozzle main body. However, in case that the coating layer is composed of the rigid plate material, there is fear in thermal shrinkage of the nozzle main body by the molten metal that the coating layer cannot follow this shrinkage and peels from the nozzle main body or is damaged. Therefore, the coating layer may be formed of the above material having the powdery shape. For example, by applying the above material having the powdery shape on the inner surface of the nozzle, the coating layer may be formed. At this time, only one kind of powdery material or mixed plural kinds of powdery materials may be used. Further, the coating layer may have the laminated structure. In this case, various kinds of powdery materials which are different in each layer may be used, or the same kind of powdery material may be used to form the laminated structure. In order to apply the powdery material readily, for example, after the powdery material mixed in solvent has been applied onto the inner surface of the nozzle main body, the solvent is dried. As the solvent, there are, for example, alcohol such as ethanol and water. A spray in which carbon powder or graphite powder is mixed in the solvent, which is on sale, may be utilized. The solvent may be dried naturally or heated to be dried more surely. Further, before the powdery material is applied, the nozzle main body may be heated to remove moisture existing in the nozzle. In case that the coating layer is formed of the powdery material, it is desirable that the powdery material is applied on the inner surface of the nozzle with no clearance thereby to prevent the contact between the molten metal and the nozzle main body. Therefore, in case that the coating layer is formed of the powdery material, it is preferable that the powdery material is applied plural times to provide the laminated structure. By mixing the powder material in the solvent and applying it as described above, the laminated structure can be readily formed. In case that sintering is performed after coating, sintering may be performed on every layer or every plural layers.

The coating layer should be provided on the inner surface of the nozzle main body and does not need to be provided on the outer surface. In case that the coating layer exists on the outer surface of the nozzle main body, and particularly on the contact portion of the nozzle main body with the rolls, there is fear that the coating layer is stripped off by friction with the rolls or damaged. In addition, in the worst case, there is fear that the nozzle itself is also damaged with the damage of the coating layer.

In the invention, pure magnesium means what includes Mg and impurities, and magnesium alloy means that an additive element and the other include Mg and impurities. As the additive element, there is at least one kind of element in an element group of Al, Zn, Mn, Si, Cu, Ag, Y, Zr, and the like. As the magnesium alloy including such the additive element, for example, an AZ-base, an AS-base, an AM-base, and a ZK-base in an ASTM mark may be utilized. Further, the nozzle of the invention can be utilized also in continuous cast of composite material composed of magnesium alloy and carbide, or composite material composed of magnesium alloy and oxide. By performing the continuous cast by means of the nozzle of the invention, it is possible to obtain a casting material that is long substantially with no limit, and particularly a sheet-shaped casting material.

Effects of the Invention

As described above, by using the casting nozzle of the invention in a twin-roll casting method, a casting material of pure magnesium or magnesium alloy can be manufactured with good productivity. Particularly, the obtained casting material is good in surface properties.

DESCRIPTION OF REFERENCE NUMERALS AND SIGNS

Figure 1:
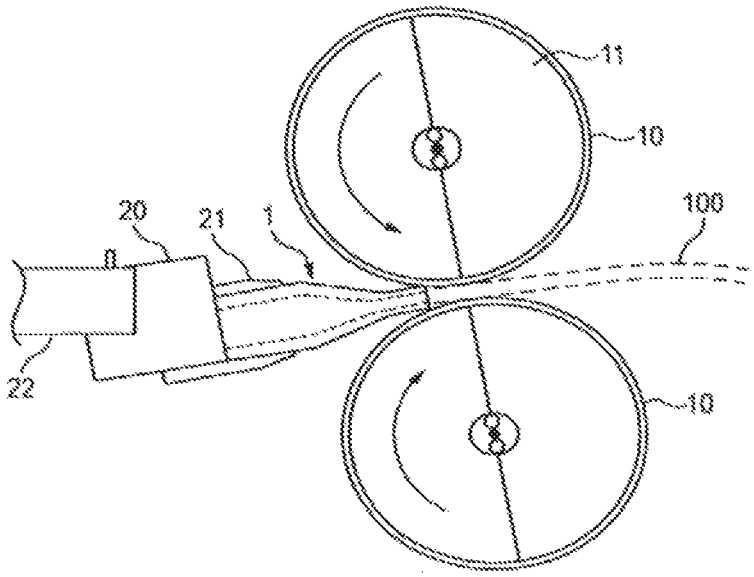
FIG. 1(A) is a schematic constitutional view showing a state where continuous cast is performed by a twin-roll casting method using a nozzle of the invention.
FIG. 1(B) is a sectional view showing a schematic constitution of the nozzle of the invention.
FIG. 1(C) is a front view of the nozzle of the invention, viewed from a pouring port side.
Figure 1:
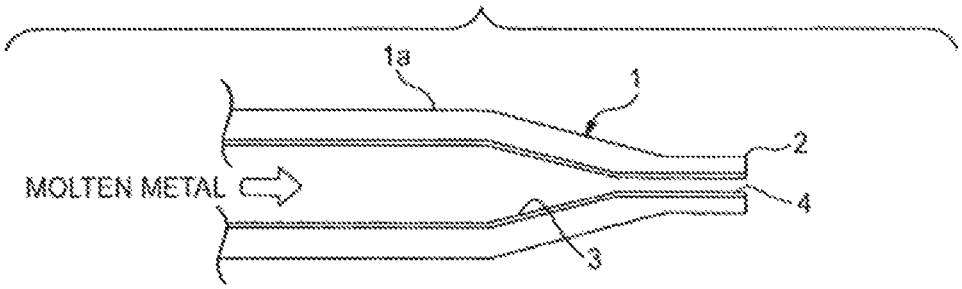
Figure 1:
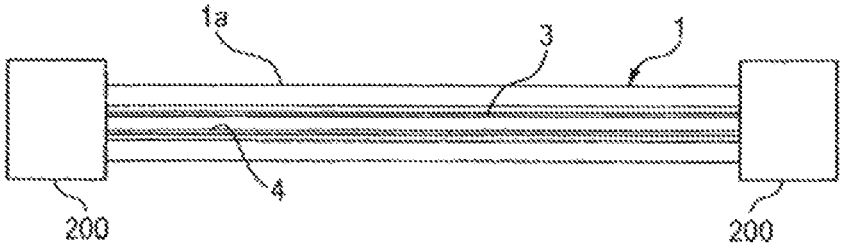

1, 1A, 1B, 1C, 1D, 1E, N Nozzle
1*a*, 1Aa, 1Ba, 1Ca, 1Da, 1Ea Main body
1*b*, 1*c* Pouring port side main body
1*bb*, 1*cc* Pouring basin side main body
2 Casting die contact portion
3, 3A, 3B, 3C, 3D, 3E Coating layer
4, 4A, 4B, 4C, 4D, 4E Pouring port
5, 6 Reinforcement member
10 Roll
11 Water path
20 Pouring basin
21 Supporter
22 Transporting conduit
100 Casting material
200 Gate

BEST MODE FOR CARRYING OUT THE INVENTION

Embodiments of the invention will be described below.

FIG. 1(A) is a diagram which explains a state where continuous cast is performed by a twin-roll casting method using a casting nozzle of the invention, FIG. 1(B) is a sectional view showing a schematic constitution of the nozzle of the invention, and FIG. 1(C) is a front view of the nozzle of the invention in a state where a gate is arranged, viewed from a pouring port side. A nozzle 1 of the invention is a member utilized as a transporting path for molten metal of pure magnesium or magnesium alloy, which supplies the molten metal which has been molten in a melting furnace (not shown) through a pouring basin to a movable casting die. Particularly, the nozzle 1 is a nozzle used in continuous cast (twin-roll casting method) using a twin roll movable casting die composed of a pair of rolls 10.

The nozzle 1 includes a cylindrical main body 1*a*, and its inner side becomes a transporting path of molten metal. One end side of the main body 1*a* having an opening part is tapered off, and the opening part on this tapered side is utilized as a pouring port 4 from which the molten metal is supplied to the casting die. The pouring port 4, as shown in FIG. 1(C), has the rectangular shape in which a long diameter (width) is larger than a short diameter (thickness). In the example shown in FIG. 1(C), in order to manufacture a casting material having a desired size, gates 200 are arranged on both sides of the pouring port 4. The width and thickness of the pouring port 4 are appropriately selected according to the width and thickness of the desired casting material. The other end side of the main body 1*a* is fixed to a pouring basin 20 which stores temporarily the molten metal from the melting furnace (not shown). In this example, in the nozzle 1, at the periphery on the pouring basin side, a stainless supporter (reinforcement member) 21 is arranged thereby to heighten rigidity of the nozzle 1. To the pouring basin 20, a transporting conduit 22 is connected, and the molten metal from the melting furnace is supplied through the transporting conduit 22 to the pouring basin 20. Then, the molten metal is transported from the pouring basin 20 to the nozzle 1, and supplied from the nozzle 1 to a portion between the rolls 10. Each roll 10 is a cylindrical body, and the rolls 10 are arranged opposed to each other with the predetermined space, and rotate in opposite directions to each other as shown by arrows in FIG. 1(A). The space between the rolls 10 is appropriately selected according to the thickness of the desired casting material. The width (length in the axial direction) of the roll 10 is appropriately selected according to the width of the desired casting material. In case that the width of the roll 10 is larger than the width of the desired casting material, gates (not shown) are appropriately provided to obtain the casting material having the desired width. Inside the roll 10, a water path 11 is provided, and water is permitted to flow therein at any time. The surface of the roll 10 is cooled by this water. Namely, the roll 10 has a so-called cooled water structure. In order to cause the pouring port 4 to be located between the rolls 10, and to make the space between the pouring 4 and the rollers 10 substantially zero, the nozzle 1 is arranged so that the peripheral side of the pouring port 4 comes into contact with the rolls 10. In the nozzle 1, a portion which comes into contact with the roll 10 becomes a casting die contact portion 2.

By utilizing the above nozzle 1 and rolls 10, a casting material 100 is obtained from the molten metal of the pure magnesium or the magnesium alloy. Specifically, the molten metal which has been molten in the melting furnace is supplied from the melting furnace through the transporting conduit 22 and the pouring basin 20 to the nozzle 1, and further supplied from the pouring port 4 of the nozzle 1 to the portion between the rolls 10. The temperature of the molten metal, while the molten metal is transported in the nozzle 1, starts to lower gradually. When the molten metal is supplied between the rolls 10, it is rapidly cooled and solidified by the contact with the rolls 10, and thereafter discharged by rotation of the rolls 10 as the casting material 100. By thus supplying the molten metal between the rolls 10 continuously, the long casting material 100 is obtained. In this example, a sheet-shaped casting material 100 is manufactured.

This nozzle 1 is characterized by including, on the inner surface of the nozzle 1 which comes into contact with the molten metal, a coating layer 3 formed of material that does not include substantially oxygen, in, order to prevent reaction between the molten metal of pure magnesium or the molten metal of magnesium alloy and the nozzle forming material. In this example, the main body 1*a* of the nozzle 1 is formed of thermal insulating material composed of oxide material such as aluminum or silica. When such the nozzle 1 comes into contact with the molten metal having Mg as a main component, there is fear that the oxygen in the thermal insulation material reacts with Mg in the molten metal and the nozzle 1 is damaged thereby to disenable cast. Therefore, on the inner surface of the nozzle 1, which comes into contact with the molten metal, the coating layer 3 is provided. In this example, the coating layer 3 is formed on the entirety of the inner surface of the nozzle 1. Further, in this example, the coating layer 3 is formed by applying graphite powers.

In the nozzle of the invention thus including the coating layer formed of the material (the material that does not include oxygen substantially in this example) that is lower in oxygen density than oxide material, the main body formed of the oxide material does not come directly into contact with the molten metal of pure magnesium or magnesium alloy that is easy to react with oxygen, and it is possible to prevent effectively the molten metal and the nozzle from reacting with each other. Further, in the nozzle of the invention, since the contact portion with the roller (casting die contact portion) is formed of the thermal insulation material, heat of the molten metal in the nozzle is difficult to be transmitted to the rollers through the casting die contact portion. Therefore, in the nozzle of the invention, it is possible to suppress the molten metal in the nozzle from being cooled through the casting die contact portion by the rollers, so that a disadvantage that the molten metal is cooled and solidified in the nozzle thereby to enable cast is difficult to be produced. Therefore, by utilizing the nozzle of the invention, the casting material can be stably manufactured. Further, in this example, since the nozzle is supported by the supporter, it is possible to prevent the nozzle main body from being distorted due to weight of the molten metal or weight of the nozzle itself.

EXAMINATION EXAMPLE 1

A nozzle having a coating layer on the inner surface of a nozzle main body as shown in FIG. 1 is manufactured, and pure magnesium or magnesium alloy is cast by means of a twin roll movable casting die shown in FIG. 1. As a comparative example, utilizing a nozzle having no coating layer, pure magnesium or magnesium alloy is cast similarly.

In this examination, as the nozzle main body, a casting nozzle by ZIRCAR, which has aluminum oxide and silicon oxide as main components, is worked and used (full length: 100 mm, thickness of leading end: 1.8 mm, width: 250 mm, sectional area on pouring basin side: 2500 $mm^2$, long diameter: 250 mm, short diameter: 10 mm, sectional area of pouring port: 1250 $mm^2$, long diameter: 250 mm, short diameter: 5 mm). Further, in the nozzle having the coating layer, the coating layer is formed on the entirety of the inner surface of the nozzle main body. In formation of the coating layer, a boron nitride spray in which boron nitride powder is mixed in solvent (ethanol), and a graphite spray in which graphite powder is mixed in solvent (ethanol) are used. After the powder is applied by one of their sprays, the powder is applied by the other spray to laminate the powdery layers. Thereafter, the laminated layers are sintered at temperature of 300° C. This lamination coating step and the sintering step are repeated five times thereby to obtain a coating layer having thickness of about 0.35 mm.

In this examination, using a twin-roll casting machine of roll diameter 1000 mm×width 500 mm, a sheet-shaped casting material of thickness 5 mm×width 250 mm is manufactured. The width of the casting material, as shown in FIG. 1(C), by providing appropriately gates 200, is adjusted so as to become the desired width. In the nozzle, one end side having a pouring port is arranged between rolls, and the other end side is fixed to a pouring basin. Further, in this examination, there are used molten metals of pure magnesium (composed of 99.9 mass % or more Mg and impurity), AZ31 corresponding alloy (including 3.0% Al, 1.0% Zn and 0.15% Mn in mass %, and others of Mg and impurity) and AZ91 corresponding alloy (including 9.0% Al, 0.7% Zn and 0.32% Mn in mass %, and others of Mg and impurity).

In result, in case that the nozzle having the coating layer is utilized, the molten metal did not react with the nozzle during casting, and a pure magnesium casting material and a magnesium alloy casting material can be obtained. To the contrary, in case that the nozzle having no coating layer is utilized, the nozzle reacted severely with the molten metal (Mg) in the casting time and is damaged, so that a casting material cannot be obtained. Further, in each nozzle, at the periphery on the pouring basin side, a stainless supporter is arranged. In this example, two stainless plates each having 0.2 mm thickness and 240 mm width are prepared, and arranged so as to put the pouring basin side of the nozzle between. Further, before the molten metal is transported, when a check near the pouring port of the nozzle is made, there is no partially distorted portion in each nozzle.

Figure 2:
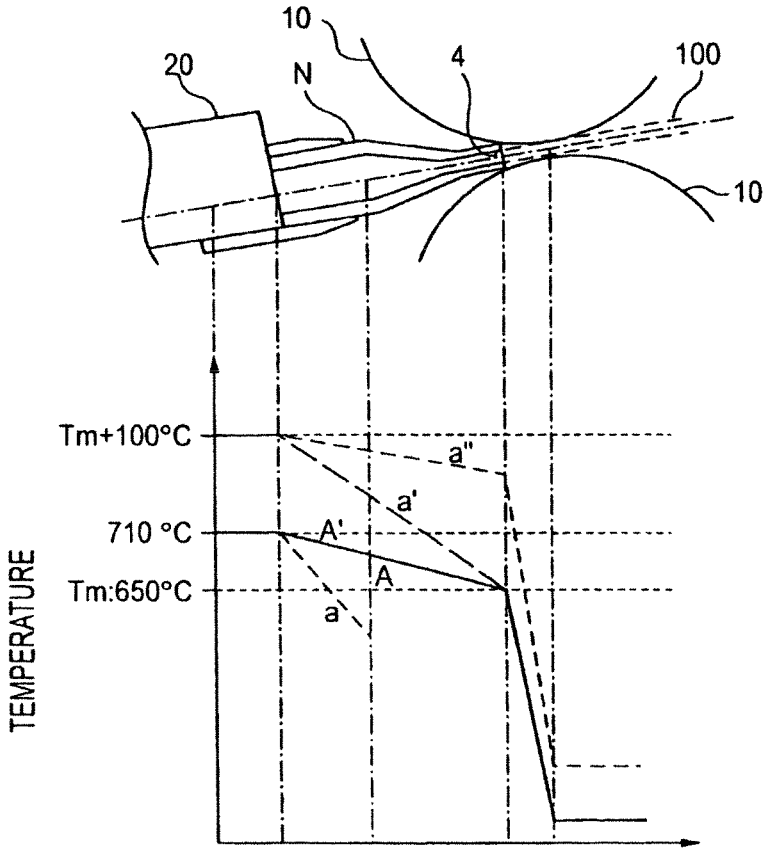
FIG. 2 is a graph showing a temperature distribution of a molten metal from a pouring basin to a portion between rolls.

Further, temperature distribution of the molten metal is investigated from the inside of the pouring basin to the portion between the rolls. As the molten metal, pure magnesium (melting point Tm: about 650° C.) is utilized. The temperature of the molten metal in the pouring basin is adjusted to about 710° C. The temperature of the molten metal is investigated by arranging temperature sensors in measurement points. A graph in FIG. 2 shows a result of this investigation. Further, as a comparative example, using a graphite nozzle manufactured in the similar shape, in a state where one end side of the nozzle where a pouring port is provided is similarly located between rolls and the other end side thereof is fixed to a pouring basin, the temperature distribution of the molten metal is investigated. This result is also shown in the graph of FIG. 2. In FIG. 2, the same parts as those in FIG. 1 are denoted by the same reference numerals and symbols.

In case that the nozzle of the invention having the coating layer on the inner surface of the main body is used, the temperature of the molten metal which is about 710° C. in the pouring basin, as shown by a solid line A in FIG. 2, became lower while the molten metal passed through the inside of the nozzle N after coming out from the pouring basin 20, approximated the melting point Tm near the pouring port 4, lowered sharply when the molten metal came out from the pouring port 4 and came into contact with the rolls 10, and became lower than the melting point. Further, after this nozzle is used for two hours, when the temperature distribution of the molten metal is similarly investigated, as shown by a dashed line A', the temperature distribution is nearly the same as that shown by the solid line A. From this result, it is confirmed that by utilizing the nozzle of the invention, a casting material could be stably obtained in use for a long period.

To the contrary, in case that the graphite nozzle is utilized, the temperature of the molten metal which is about 710° C. in the pouring basin 20, as shown by a dashed line a, became lower than the melting point Tm in the nozzle and the molten metal is solidified, so that the molten metal cannot be cast. It is thought that this is because the graphite is better in thermal conductivity than the thermal insulation material used in the nozzle of the invention and the graphite nozzle is cooled in contact with the rolls, whereby the molten metal in the nozzle is also cooled and the temperature of the molten metal lowers. Therefore, in order to enable the cast, it is necessary to make the temperature of the molten metal in the pouring basin 20 higher than the melting point Tm by 100° C. When the temperature distribution is investigated in this state, the temperature of the molten metal which is Tm+100° C. in the pouring basin 20, as shown by a dashed line a', became lower while the molten metal passed through the inside of the nozzle N after coming out from the pouring basin 20, approximated the melting point Tm near the pouring port 4, lowered sharply when the molten metal came out from the pouring port 4 and came into contact with the rolls 10, and became lower than the melting point. From this result, it is confirmed that: in case that the graphite nozzle is utilized, the temperature of the molten metal is increased thereby to enable the cast without reaction between the molten metal and the nozzle, as in the nozzle of the invention. However, after this nozzle is used for ten minutes, when the temperature of the molten metal is similarly investigated, the temperature of the molten metal, as shown by a dashed line a", did not lower to an approximation of the melting point Tm even near the pouring port 4, a difference between the temperature near the pouring port 4 and the temperature at the contact portion of the molten metal with the rolls 10 became large, and defects such as casting wrinkles are produced on the surface of the obtained casting material. It is thought that this is because the nozzle is kept warm by the molten metal since the graphite is good in thermal conductivity as described above, whereby the temperature of the nozzle increases and the temperature of the molten metal is difficult to lower. Therefore, in case that the graphite nozzle is utilized, it is necessary to make the temperature of the molten metal higher; and when the casting material is manufactured for a long period, it is necessary to cool the nozzle appropriately. Accordingly, utilizing the nozzle of the invention enables the casting material to be manufactured with better productivity.

EXAMINATION EXAMPLE 2

Regarding the nozzle having the coating layer used in the examination example 1, nozzles which are different in coating layer forming area are manufactured. In this examination, plural nozzles each of which has the coating layer on the pouring basin on the inner surface of the nozzle, and no coating layer on the pouring port side thereof are manufactured. Specifically, by gradually backing the coating layer forming area on the inner surface of the nozzle from the pouring port side of the nozzle, nozzles which are different in size (length) from the pouring port side to the coating layer forming area are manufactured. The nozzle provided with a portion having the coating layer and a portion having no coating layer is obtained by previously masking the portion having no coating layer, and forming a coating layer on a portion except the masking portion. In this examination, by performing masking with different distances from the pouring port, the forming area of the coating layer is changed, whereby the plural nozzles which are different in size from the pouring port side to the coating layer forming area are manufactured. In the thus obtained each nozzle which had the coating layer on the pouring basin and no coating layer on the pouring port side, a temperature sensor (thermocouple) is buried in a boundary between the coating layer forming portion and the coating layer not-forming portion, and temperature distribution in each nozzle is investigated. As molten metal, pure magnesium, AZ31 corresponding alloy, and AZ91 corresponding alloy similar to those in the examination example 1 are used.

In result, in any molten metal of pure magnesium and magnesium alloy, in a portion where the temperature of the molten metal in the nozzle is higher than a melting point (liquidus temperature) by about 13 to 15° C., sharp reaction is produced, and the whole of the nozzle is damaged. From this result, it is conformed that: when the coating layer is provided on a portion where the temperature of the molten metal in the nozzle becomes at least a melting point+Tm° C., and particularly on the pouring basin side area, it is possible to prevent a disadvantage that cast became impossible due to reaction between the nozzle formed of high oxygen material and the molten metal, or the nozzle is damaged.

EXAMINATION EXAMPLE 3

A nozzle having a coating layer on the whole of the inner surface of a nozzle main body, which is used in the examination example 1, and a nozzle having a coating layer on a portion except the vicinity of a pouring port are manufactured. Using the twin roll casting die shown in FIG. 1, pure magnesium and magnesium alloy are cast. The nozzle having no coating layer near the pouring port is obtained by masking the area which is 30 mm distant from the pouring port, and forming a coating layer on a portion except this masking portion. The coating layer is formed similarly to in the examination example 1. In this example, a 200 kg casting sheet of thickness 4.5 mm×width 200 mm is manufactured. The thickness of the casting sheet is changed by adjusting the distance between the rollers. Further, the width of the casting sheet is adjusted by appropriately providing gates. As molten metal, similarly to in the examination example 1, pure magnesium, AZ31 corresponding alloy, and AZ91 corresponding alloy are used.

In result, in any nozzle, a 200 Kg casting sheet could be manufactured without any problems. Particularly, in the nozzle having no costing layer near the pouring port, the sectional area of the pouring port is not reduced by the coating layer, and the sectional area of the pouring port is larger than that in the nozzle having the coating layer also near the pouring port. Therefore, without increasing supply-pressure of the molten metal, a casting material that is good in surface properties could be obtained. To the contrary, in the nozzle having the coating layer on the whole of the inner surface of the nozzle, the short diameter of the pouring port is reduced by the coating layer (thickness 3.5 mm) by about 0.7 to 0.8 mm. Therefore, in order to reduce deterioration of the surface properties caused by decrease in sectional area of the pouring port, it is necessary to perform such an operation as to increase the pouring pressure of the molten metal.

EXAMINATION EXAMPLE 4

Figure 3:
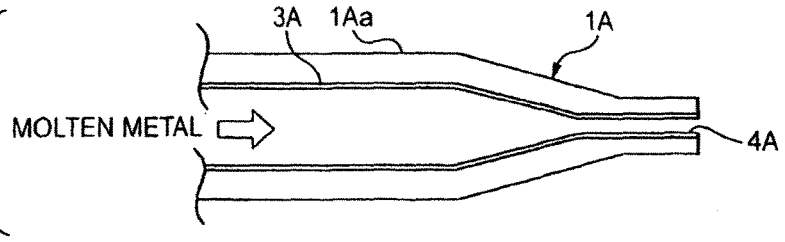
FIG. 3 is a sectional view showing other embodiments of the nozzle of the invention, in which (A) shows an example in which forming material of a nozzle is different from that of the nozzle shown in FIGS. 1, (B) and (C) show examples in which a main body is formed of two kinds of materials that are different from each other, and (D) and (E) show examples in which a reinforcement member is provided.
Figure 3:
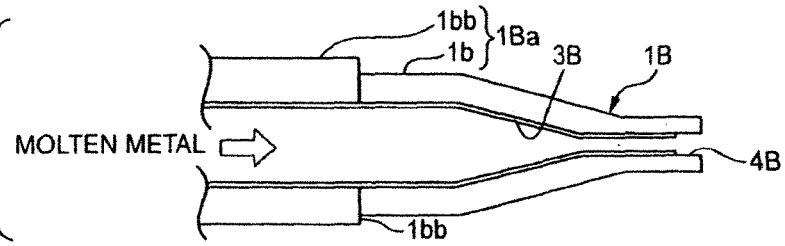
Figure 3:
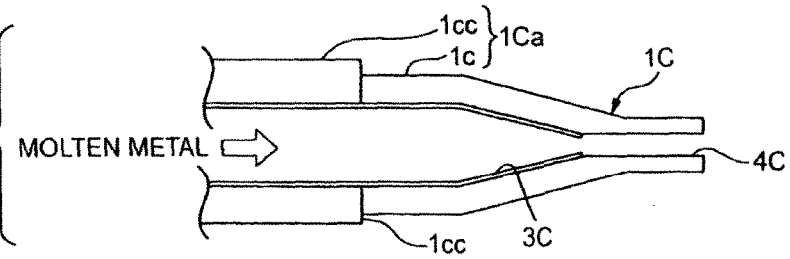
Figure 3:
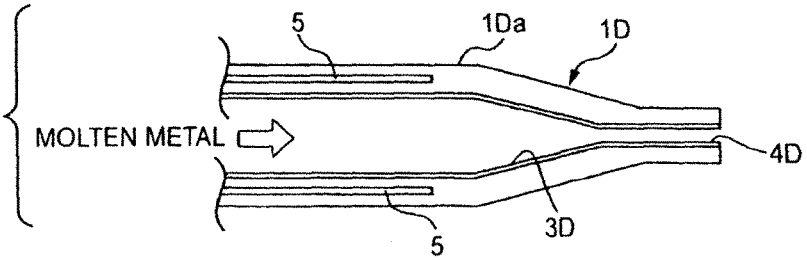
Figure 3:
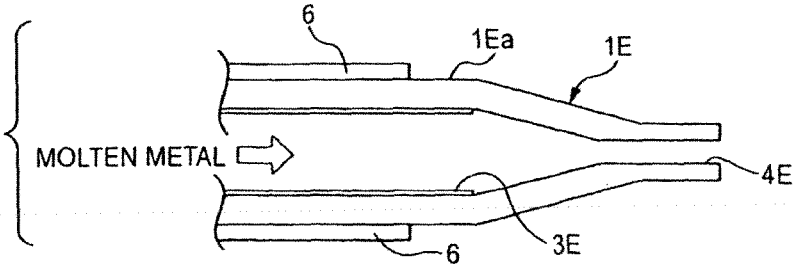

Various nozzles as shown in FIG. 3 are manufactured, and magnesium and magnesium alloy are cast, using the twin roll movable casting die shown in FIG. 1. In this examination, a 100 kg casting sheet of thickness 5 mm×width 250 mm is manufactured, using a similar twin-roll casting machine of roll diameter 1000 mm×width 500 mm to that in the examination example. As molten metal, similarly to in the examination example 1, pure magnesium, AZ31 corresponding alloy, and AZ91 corresponding alloy are used.

In a nozzle 1A shown in FIG. 3(A), a main body 1Aa is formed of calcium silicate (which has a density of 0.78 g/cc and has thermal conductivity of 0.19 W/mK at 600° C.), and a coating layer 3A is provided on the whole of the inner surface of the main body 1Aa. The coating layer 3A, using a spray in which mixed powder of boron nitride and graphite is mixed in solvent (ethanol), by repeating ten times an operation of applying the powder on the inner surface of the main body 1Aa, and thereafter sintering the applied powder at 160° C. temperature, is formed with about 0.2 mm thickness. A pouring port 4A for which the coating layer 3A is provided has the rectangular shape of longer diameter 250 mm and short diameter 5 mm.

Further, in a nozzle 1A shown in FIG. 3(A), a main body 1Aa is formed of calcium silicate (which has a density of 0.83 g/cc and has thermal conductivity of 0.145 W/mK at 600° C.), and a coating layer 3A is provided on the whole of the inner surface of the main body 1Aa. The coating layer 3A, using a spray in which mixed powder of boron nitride and graphite is mixed in solvent (ethanol), by repeating ten times an operation of applying the powder on the inner surface of the main body 1Aa, and thereafter sintering the applied powder at 160° C. temperature, is formed with about 0.2 mm thickness. A pouring port 4A for which the coating layer 3A is provided has the rectangular shape of longer diameter 250 mm and short diameter 5 mm.

Still further, in a nozzle 1A shown in FIG. 3(A), a main body 1Aa is formed of $Al_2O_3$ (which has a density of 0.19~0.26 g/cc and has thermal conductivity of 0.11 W/mK at 600° C.), and a coating layer 3A is provided on the whole of the inner surface of the main body 1Aa. The coating layer 3A, using a spray in which mixed powder of boron nitride and graphite is mixed in solvent (ethanol), by repeating ten times an operation of applying the powder on the inner surface of the main body 1Aa, and thereafter sintering the applied powder at 160° C. temperature, is formed with about 0.2 mm thickness. A pouring port 4A for which the coating layer 3A is provided has the rectangular shape of longer diameter 250 mm and short diameter 5 mm.

Still further, in a nozzle 1A shown in FIG. 3(A), a main body 1Aa is formed of $SiO_2$ (which has a density of 0.46 g/cc and has thermal conductivity of 0.16 W/mK at 600° C.), and a coating layer 3A is provided on the whole of the inner surface of the main body 1Aa. The coating layer 3A, using a spray in which mixed powder of boron nitride and graphite is mixed in solvent (ethanol), by repeating ten times an operation of applying the powder on the inner surface of the main body 1Aa, and thereafter sintering the applied powder at 160° C. temperature, is formed with about 0.2 mm thickness. A pouring port 4A for which the coating layer 3A is provided has the rectangular shape of longer diameter 250 mm and short diameter 5 mm.

Still further, in a nozzle 1A shown in FIG. 3(A), a main body 1Aa is formed of $SiO_2$ (which has a density of 0.69 g/cc and has thermal conductivity of 0.38 W/mK at 600° C.), and a coating layer 3A is provided on the whole of the inner surface of the main body 1Aa. The coating layer 3A, using a spray in which mixed powder of boron nitride and graphite is mixed in solvent (ethanol), by repeating ten times an operation of applying the powder on the inner surface of the main body 1Aa, and thereafter sintering the applied powder at 160° C. temperature, is formed with about 0.2 mm thickness. A pouring port 4A for which the coating layer 3A is provided has the rectangular shape of longer diameter 250 mm and short diameter 5 mm.

Still further, in a nozzle 1A shown in FIG. 3(A), a main body 1Aa is formed of $SiO_2$ (which has a density of 1.10 g/cc and has thermal conductivity of 1.00 W/mK at 600° C.), and a coating layer 3A is provided on the whole of the inner surface of the main body 1Aa. The coating layer 3A, using a spray in which mixed powder of boron nitride and graphite is mixed in solvent (ethanol), by repeating ten times an operation of applying the powder on the inner surface of the main body 1Aa, and thereafter sintering the applied powder at 160° C. temperature, is formed with about 0.2 mm thickness. A pouring port 4A for which the coating layer 3A is provided has the rectangular shape of longer diameter 250 mm and short diameter 5 mm.

In a nozzle 1B shown in FIG. 3(B), a pouring port side of a main body 1Ba is different in forming material from a pouring basin side thereof. A pouring port side main body 1*b* is formed of aluminum sintering compact, and a pouring basin side main body 1*bb* is formed of graphite. On the inner surface of this main body 1Ba, a coating layer 3B is provided at a portion except the vicinity of a pouring port 4B (except area which is 0.3 mm distant from the pouring port). The coating layer 3B, preparing a boron nitride spray in which boron nitride powder is mixed in solvent (ethanol), and a graphite spray in which graphite powder is mixed in solvent (ethanol), by repeating ten times an operation of laminating the powders on the inner surface of the main body 1Ba (except the vicinity of pouring port where masking is applied), using alternately the both sprays, and thereafter sintering the laminated powders at 300° C. temperature, is formed with about 0.4 mm thickness. A pouring port 4B has the rectangular shape of longer diameter 250 mm and short diameter 5.4 mm.

In a nozzle 1C shown in FIG. 3(C), similarly to in the nozzle 1B, a pouring port side of a main body 1Ca is different in forming material from a pouring basin side thereof. A pouring port side main body 1*c* is formed of boron nitride sintering compact, and a pouring basin side main body 1*cc* is formed of graphite. On the inner surface of this main body 1Ca, a coating layer 3C is provided partially on the inner surface of the pouring port side main body 1*c*, and not is provided in an area which is 40 mm distant from the pouring port, and on the inner surface of the pouring basin side main body 1*cc* formed of graphite. The coating layer 3C, using a spray in which mixed powder of boron nitride, carbon and graphite is mixed in solvent (ethanol), by repeating eight times an operation of applying the powders onto the inner surface of the main body 1Ca (except the vicinity of pouring port where masking is applied, and the pouring basin side main body), and thereafter sintering the applied powders at 160° C. temperature, is formed with about 0.4 mm thickness. A pouring port 4C has the rectangular shape of longer diameter 250 mm and short diameter 5.4 mm.

In a nozzle 1D shown in FIG. 3(D), a main body 1Da is formed of Isowool Board (of which main components are alumina and silica) by ISOLITE, and a coating layer 3D is provided on the whole of the inner surface of the main body 1Da. The coating layer 3D, using a spray in which boron nitride powder is mixed in solvent (ethanol), by repeating five times an operation of applying the powder on the inner surface of the main body 1Da, and thereafter sintering the applied powder at 160° C. temperature, is formed with about 0.25 mm thickness. A pouring port 4D for which the coating layer 3D is provided has the rectangular shape of longer diameter 250 mm and short diameter 4.9 mm. This nozzle 1D contains plural stainless bars inserted into the main body 1Da as reinforcement members 5. In this example, particularly, the reinforcement members 5 are arranged on the pouring basin side. By thus arranging the reinforcement members 5, the nozzle 1D can prevent the main body 1Da from being deformed by weight of molten metal.

In a nozzle 1E shown in FIG. 3(E), a main body 1Ea is formed of a calcium silicate board, and a coating layer 3E is provide only on the pouring basin side of the inner surface of the main body 1Ea but is not provided on the pouring port side (in an area which is 75 mm distant from a pouring port 4E). Namely, in this nozzle 1E, the coating layer 3E is provided only on a portion of the inner surface which comes into contact with molten metal of which the temperature is Tm+10° C. or more. The coating layer 3E, using a spray in which graphite powder is mixed in solvent (ethanol), by repeating eight times an operation of applying the powder on the inner surface of the main body 1Ea (except the area on the pouring port side to which masking has been applied), and thereafter sintering the applied powder at 300° C. temperature, is formed with about 0.4 mm thickness. The pouring port 4E has the rectangular shape of longer diameter 250 mm and short diameter 5.4 mm. This nozzle 1E, similarly to the nozzle 1D, has reinforcement members 6 arranged on the pouring basin side of the main body 1Ea. In the nozzle 1E, stainless plates are arranged as the reinforcement member 6 on the peripheral surface of the main body 1Ea. In this example, particularly, the reinforcement members 6 are arranged on the pouring basin side. By thus arranging the reinforcement members 6, the nozzle 1E can prevent the main body 1Ea from being deformed by weight of the molten metal.

When cast is performed using the above nozzles, in any nozzles, without any problems, a casting sheet of 100 Kg is manufactured. At this time, in the nozzles 1B, 1C and 1E each of which has no coating layer near the pouring port, since the sectional area of the pouring port is not reduced by the coating layer, the casting material which is good in surface properties could be obtained without increasing the supply-pressure of the molten metal. In the nozzles 1A and 1D each of which has the coating layer on the whole of the inner surface of the nozzle, though the area of the pouring port is reduced by the coating layer, the casting material which is good in surface properties could be obtained by performing such an operation as to increase the pouring pressure of the molten metal.

Further, in the nozzles 1B and 1C where a part of each nozzle main body is formed of graphite that is good in thermal conductivity, the heater or the like could be arranged at the periphery of the pouring basin side main body formed of graphite to heat the molten metal, whereby lowering of the melting temperature in the nozzle could be reduced. Further, when a wear-resistant member is arranged on the movable casting die contact side of the nozzle, the nozzle damage caused by slide with the movable casting die could be reduced.

Although the invention has been described in detail and with reference to specified embodiments, it will be obvious to those skilled in the art that various changes and modifications may be made without departing from the spirit and scope of the invention.

INDUSTRIAL APPLICABILITY

The casting nozzle of the invention, when continuous cast of magnesium or magnesium alloy is performed, can be preferably utilized as a molten metal transporting member which supplies molten metal from a melting furnace to a movable casting die.

The invention claimed is:

1. A casting nozzle which supplies molten metal of pure magnesium or magnesium alloy into a twin roll movable casting die, the casting nozzle comprising:

a nozzle main body formed of a thermal insulation material, and a molten metal contact portion on the nozzle main body formed of a layer of low oxygen material, wherein the thermal insulation material is composed of an oxide material having mainly aluminum oxide or calcium silicate with a thermal conductivity of 1.00 W/mK at 600° C. or less, and wherein the molten metal contact portion terminates inside the nozzle main body at a distance of 0.3 mm to 40 mm from a mouth of a pouring port of the casting nozzle.

* * * * *